US005078541A

United States Patent [19]

Gola

[11] Patent Number: 5,078,541

[45] Date of Patent: Jan. 7, 1992

[54] METHOD FOR LAUNCHING AND RETRIEVING A BOAT

[76] Inventor: Daniel B. Gola, 750 Old Highway 8, Apt. 104, New Brighton, Minn. 55112

[21] Appl. No.: 554,916

[22] Filed: Jul. 20, 1990

[51] Int. Cl.[5] ..... B63C 3/02

[52] U.S. Cl. ..... 405/1; 405/3

[58] Field of Search ..... 405/1, 3; 114/344; 280/414.1; 414/559

[56] References Cited

U.S. PATENT DOCUMENTS 3,154,799 11/1964 Jalowiecki .
3,603,465 9/1971 King .
3,800,968 4/1974 Thompson ..... 405/1 X
3,848,892 11/1974 Reder .
3,951,433 4/1976 Starkey .
4,300,252 11/1981 Montooth .
4,352,668 10/1982 Beevers et al. .
4,429,893 2/1984 Palamara .
4,505,619 3/1985 Sargent ..... 405/1 X
4,553,897 11/1985 Briggs .
4,601,606 7/1986 Eason ..... 405/1
4,771,987 9/1988 Priest .
4,895,387 1/1990 Hawkins et al. .

*Primary Examiner*—David H. Corbin
*Attorney, Agent, or Firm*—Hugh D. Jaeger

[57] ABSTRACT

Method for launching and retrieving a boat by attaching a hook on a constant tension line connected to a reel. The reel includes a length of retractable line which is reeled out to a predetermined point, and a button on the reel housing engages the reel to set the length of line on the reel.

3 Claims, 2 Drawing Sheets

METHOD FOR LAUNCHING AND RETRIEVING A BOAT

BACKGROUND OF THE INVENTION

1. Field of the Invention

The present invention pertains to a method for launching and retrieving a boat from a boat trailer, and more particularly, pertains to a method of use of a reel with a constant tension line hooked on a boat.

2. Description of the Prior Art

Boaters in the past have struggled in launching a boat to hold on to the boat either physically or attached some type of a piece of line to hold on to the boat and secure the boat while launching the boat at the same time. Usually the piece of line is an anchor rope which is not always easily accessible and is awkward. Some boaters even launch a boat and forget to hold on to the boat where the boat literally rolls off the trailer and floats out onto the water out of the reach and grasp of the boater.

Generally, boaters have not had a readily accessible reel of line which the length can be set by a push button for launching and securing of a boat with a length of line.

The present invention overcomes the disadvantages of the prior art by providing an adjustable length of line on a reel for launching and retrieving of a boat. After the boat has rolled off the trailer into the water, the boat may be guided back to shore by simply pressing the button, locking the line, pulling on the handle of the reel assembly and repeating the process. The constant tension line will reel up automatically as the boat approaches.

SUMMARY OF THE INVENTION

The general purpose of the present invention is to provide a method for launching and securing of a boat by utilizing a constant tension line on a reel which can be adjustably set to any length.

According to one embodiment of the present invention, there is provided a method for launching and securing of a boat including the steps of hooking a hook on a length of line on a reel onto an eye or a cleat of a boat, letting the boat pull out as much line as is needed without tension, setting the length of line through engagement of a push button on the reel housing thereby setting the length of constant tension line from the reel, retrieving the boat to shore with a gentle pull, and reeling in extra line by the constant tension on the line through spring biasing on the reel in the reel housing by action of the push button.

Significant aspects and features of the present invention include a reel housing which includes a hand grip and a push button, which is thumb actuated on the hand grip from releasing tension on the line.

Another significant aspect and feature of the present invention is a length of line on the reel in the reel housing which can be set to any predetermined length by engaging of the push button which locks the reel in the reel housing.

One object of the present invention is providing a readily available length of line for boating from a reel housing.

Having thus described the preferred embodiments of the present invention, it is a principal object hereof to provide a method for launching and securing a boat with the steps for the use of a line on a reel in a reel housing including a push button for engaging a set length of constant tension line extending out from the reel housing.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
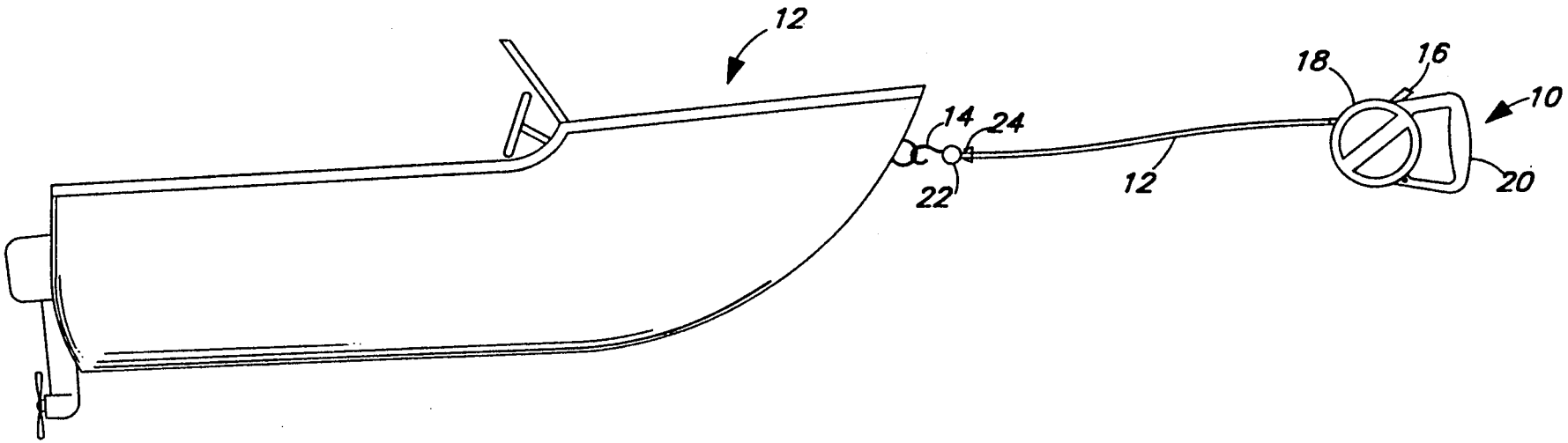
FIG. 1 illustrates a plan view of a boat being launched and retrieved by a line on a reel in housing.

FIG. 1 illustrates a reel 10 of the present invention for the method of launching or retrieving a boat 12. The reel 10 includes a reel housing 18, a hand grasp 20, a constant tension retractable line 12 with a snap hook 14 attached to one end of the line 12 through an optional fitting 22 and an optional ring 24. The other end of the line attaches to the reel which is rotatably engaged in the reel housing 18. A button 16 in the reel housing engages the spring biased reel so as to allow the user to set a length of line extending from the reel housing.

Figure 2:
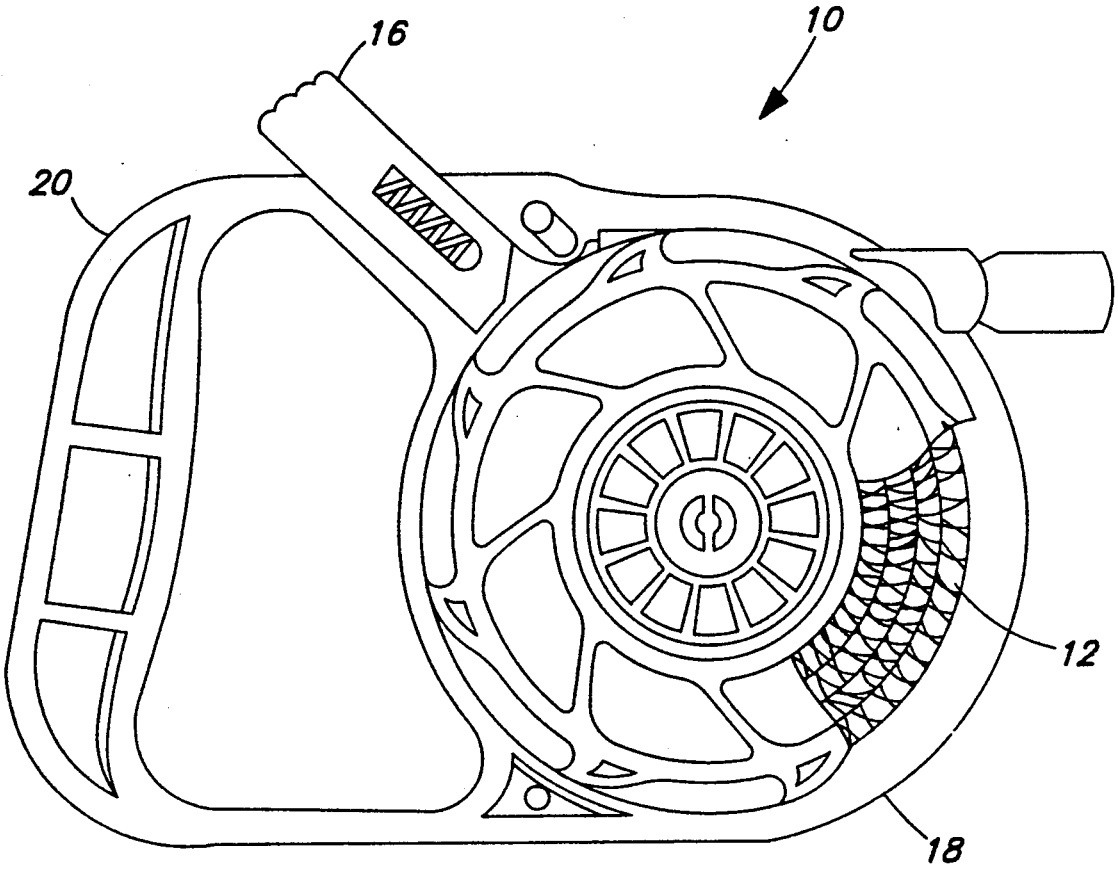
PRIOR ART FIG. 2
FIG. 2 illustrates a cross sectional view of the reel in the reel housing.

FIG. 2 illustrates a plan view of the reel in the reel housing like that sold by Flexi of Hamburg, West Germany.

MODE OF OPERATION

A user attaches a snap hook onto the eye, cleat, or other hookable portion of the boat and then lets the line reel out as the boat rolls off the trailer, and then engages the button to affix the reel in the reel housing against further movement. The boat can then be retrieved and guided to shore or to a dock.

The user can also hook the line onto the boat and use a portion of the line to tie off to a dock pole with the remaining portion conveniently engaged on the reel in the reel housing.

The user can also use the same apparatus for the method of fishing by attaching a fish hook onto the line.

Various modifications can be made to the present invention without departing from the apparent scope hereof.

I claim:

1. Method for launching a boat comprising the steps of:

a. hooking a hook on a length of constant tension line on a reel in a hand-held housing onto a boat;

b. pushing the boat off a trailer onto the water and running out a length of line from said reel;

c. playing out a length of constant tension line from said reel; and, d. holding out said housing to control the action of the boat during a launching maneuver whereby said line is under constant tension.

2. Method for launching a boat according to claim 1 comprising the steps of:

a. pulling in the boat through said line attached to the reel housing;

b. pushing in a lock button on the reel housing; and, c. reeling in excess constant tension line on said reel of said hand-held housing.

3. Method for launching a boat comprising the steps of:

a. hooking a hook on a length of constant tension line on a reel in a hand-held housing onto a boat;

b. pushing the boat off a trailer onto the water and running out a length of line from said reel;

c. playing out a length of constant tension line from said reel;

d. holding onto said housing to control the action of the boat during a launching maneuver whereby said line is under constant tension;

e. pulling in the boat through the line attached to the reel housing;

f. pushing in the button on the reel housing; and, g. reeling in excess constant tension line.

* * * * *